US007370997B2

(12) United States Patent
Komatsu

(10) Patent No.: US 7,370,997 B2
(45) Date of Patent: May 13, 2008

(54) LIGHTING UNIT FOR VEHICLE

(75) Inventor: Motohiro Komatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 245 days.

(21) Appl. No.: 11/082,941

(22) Filed: Mar. 18, 2005

(65) Prior Publication Data

US 2005/0207162 A1 Sep. 22, 2005

(30) Foreign Application Priority Data

Mar. 18, 2004 (JP) ..... P.2004-077529

(51) Int. Cl.
*F21V 5/00* (2006.01)
*F21V 21/00* (2006.01)

(52) U.S. Cl. ..... 362/545; 362/507; 362/509; 362/511; 362/521

(58) Field of Classification Search ..... 362/475, 362/507, 509, 511, 520, 521, 522, 545, 800, 362/326, 331, 332, 334, 335
See application file for complete search history.

(56) References Cited

U.S. PATENT DOCUMENTS 6,099,156 A 8/2000 Jenkins et al.
6,997,587 B2 * 2/2006 Albou ..... 362/516
7,097,334 B2 * 8/2006 Ishida et al. ..... 362/516
2003/0147252 A1 8/2003 Fioravanti
2005/0094401 A1 * 5/2005 Magarill ..... 362/296

FOREIGN PATENT DOCUMENTS

DE 20206833 U1 8/2002
EP 1357334 A1 10/2003
JP 2002 141556 A 5/2002

* cited by examiner

*Primary Examiner*—Jacob Y. Choi
(74) *Attorney, Agent, or Firm*—Sughrue Mion, PLLC

(57) ABSTRACT

A light emitting unit is provided forward in the vicinity of the upper part of an optical axis extended in the longitudinal direction of a lighting unit. Furthermore, a light transmitting member is provided on the forward side of the light emitting unit. A front surface of the light transmitting member is constituted by a rotating elliptical surface with the optical axis to be a central axis, and a rear end face is formed to pass through a first focal point on the rear side of the rotating elliptical surface. Moreover, a reflector having a reflecting plane formed to surround a light emitting chip almost cylindrically is provided between the light emitting unit and the light transmitting member in such a manner that a front end opening portion is caused to abut on the rear end face 14*b* of the light transmitting member.

10 Claims, 13 Drawing Sheets

LIGHTING UNIT FOR VEHICLE

The present application claims foreign priority under 35 USC 119, based on Japanese Patent Application No. 2004-077529, filed Mar. 18, 2003, the contents of which are incorporated herein by reference in their entirety. This priority claim is being made concurrently with the filing of this application.

BACKGROUND OF THE INVENTION

1. Technical Field

The present invention relates to a lighting unit for a vehicle in which a light emitting unit such as a light emitting diode is used as a light source.

2. Related Art

In recent years, there have been employed a large number of related art lighting units for a vehicle in which a light emitting diode is used as a light source.

For the foregoing related art, Japanese publication JP-A-2002-50214 discloses a lighting unit for a vehicle comprising a light emitting diode provided toward the front part of the lighting unit and a light transmitting member provided on the forward side of the light emitting diode.

The related art lighting unit is constituted to lead a light emitted from the light emitting diode and incident on the rear end of the light transmitting member to the front end face of the light transmitting member and to emit the light from the front end face, and further, to irradiate the light onto the forward part of the lighting unit through a projection lens provided in front thereof.

In the lighting unit for a vehicle described in JP-A-2002-50214, a light emitted from the light transmitting member is refracted in such a direction as to separate from the optical axis of the projection lens on the front end face of the light transmitting member. Therefore, the rate of the light incident on the projection lens is decreased. Consequently, there is a related art problem in that a luminous flux utilization rate for a light emitted from the light emitting diode is not very high.

SUMMARY OF THE INVENTION

In consideration of such circumstances, it is an object of the invention to provide a lighting unit for a vehicle using a light emitting unit as a light source in which a luminous flux utilization rate for a light emitted from the light emitting unit can be increased.

It is also an object of the present invention to overcome the related art problems. However, the present invention can be realized without achieving this object, or any object. Further, other objects may also be achieved with respect to the present invention.

The invention achieves the object by providing a light transmitting member having a predetermined shape on the forward side of the light emitting unit and a predetermined reflector or a second light transmitting member between the light emitting unit and the light transmitting member.

More specifically, a first aspect of the invention is directed to a lighting unit for a vehicle comprising a light emitting unit provided forward in the vicinity of an upper part of an optical axis extended in a longitudinal direction of the lighting unit and a light transmitting member provided on a forward side of the light emitting unit, wherein the light transmitting member has a front surface constituted by a rotating elliptical surface with the optical axis to be a central axis and a rear end face formed to pass through a first focal point on a rear side of the rotating elliptical surface, and a reflector having a reflecting plane formed to surround a light emitting portion of the light emitting unit almost cylindrically is provided between the light transmitting member and the light emitting unit in such a manner that a front end opening portion of the reflector is caused to abut on the rear end face of the light transmitting member.

Moreover, a second aspect of the invention is directed to a lighting unit for a vehicle comprising a light emitting unit provided forward in the vicinity of an upper part of an optical axis extended in a longitudinal direction of the lighting unit and a light transmitting member provided on a forward side of the light emitting unit, wherein the light transmitting member has a front surface constituted by a rotating elliptical surface with the optical axis to be a central axis and a rear end face formed to pass through a first focal point on a rear side of the rotating elliptical surface, and a second light transmitting member having an outer peripheral surface formed to surround a light emitting portion of the light emitting unit almost cylindrically and serving to internally reflect a light emitted from the light emitting portion and a front end face for forward emitting the light emitted from the light emitting portion and reflected internally by the outer peripheral surface is provided between the light transmitting member and the light emitting unit in such a manner that the front end face of the second light transmitting member is caused to come in face contact with the rear end face of the light transmitting member.

The "light emitting unit" implies an element-shaped light source having a light emitting portion for emitting a light like a dot, and a type thereof is not particularly restricted. For example, but not by way of limitation, it is possible to employ a light emitting diode and a laser diode.

If the "light transmitting member" has a light transmitting property, a material thereof is not particularly restricted but it is possible to employ a light transmitting member constituted by a transparent synthetic resin or a glass, for example.

If the "rear end face" of the light transmitting member is formed to pass through a first focal point on the rear side of a rotating elliptical surface, a specific shape thereof is not particularly restricted but it is possible to employ a plane or a curved surface which is orthogonal to an optical axis or a plane or a curved surface which is inclined slightly with respect to an orthogonal plane to the optical axis or an orthogonal curved surface to the optical axis, for example.

If the "reflector" according to the first aspect of the invention has a reflecting plane formed to surround the light emitting portion of the light emitting unit almost cylindrically, a specific structure such as the shape of the surface of the reflecting plane or the shape of the inner peripheral edge of the front end opening portion is not particularly restricted.

If the "second light transmitting member" according to the second aspect of the invention has a light transmitting property, a material thereof is not particularly restricted but it is possible to employ a structure with a transparent synthetic resin or a structure with a glass, for example. If the "second light transmitting member" is constituted to forward emit, from the front end face, a light emitted from the light emitting portion and reflected internally by the outer peripheral surface formed to surround the light emitting portion almost cylindrically, a specific structure such as the shape of the surface of the outer peripheral surface or the shape of the outer peripheral edge of the front end face is not particularly restricted.

The present invention has various advantages. As indicated with the structure, the lighting unit for a vehicle according to the first aspect of the invention has the light emitting unit provided forward in the vicinity of the upper part of the optical axis extended in the longitudinal direction of the lighting unit and the light transmitting member provided on the forward side of the light emitting unit. The light transmitting member has a front face constituted by the rotating elliptical surface with the optical axis to be a central axis, and has a rear end face formed to pass through the first focal point on the rear side of the rotating elliptical surface. Moreover, the reflector having the reflecting plane formed to surround the light emitting portion almost cylindrically is provided between the light transmitting member and the light transmitting unit in such a manner that the front end opening portion is caused to abut on the rear end face of the light transmitting member. Therefore, it is possible to obtain at least the following functions and advantages.

More specifically, a part of the light emitted from the light emitting unit directly reaches the position of the front end opening of the reflector, and furthermore, most of other lights emitted from the light emitting unit are reflected by the reflecting plane of the reflector once or more and then reach the position of the front end opening. Thereafter, the light reaching the position of the front end opening other than a part of the light reflected by the surface of the rear end face of the light transmitting member is incident on the light transmitting member without a leakage. Consequently, it is possible to increase a luminous flux utilization rate for the light emitted from the light emitting unit.

In that case, the rear end face of the light transmitting member is formed to pass through the first focal point on the rear side of the rotating elliptical surface constituting the front face. Therefore, a light distribution pattern formed by the light emitted from the front face of the light transmitting member has a shape obtained by reversing and projecting the shape of the inner peripheral edge of the front end opening portion of the reflector abutting on the rear end face. If the shape of the inner peripheral edge of the front end opening portion is set to have a shape obtained by reversing the desirable shape of a light distribution pattern, it is possible to obtain the light distribution pattern having the desirable shape.

In addition, the light emitted from the light emitting unit is incident equally on the light transmitting member in the whole area of a space on the inner peripheral side of the front end opening portion of the reflector. Therefore, it is possible to form a light distribution pattern having a small light distribution unevenness. Moreover, the front end opening portion of the reflector abuts on the rear end face of the light transmitting member. Therefore, the front end opening portion can be accurately placed in the position of the first focal point of the rotating elliptical surface. Consequently, it is possible to accurately form a light distribution pattern having a desirable shape.

On the other hand, in the lighting unit for a vehicle according to the second aspect of the invention, the light emitting unit is forward provided in the vicinity of the upper part of the optical axis extended in the longitudinal direction of the lighting unit, and furthermore, the light transmitting member is provided on the forward side of the light emitting unit. The light transmitting member has the front surface constituted by the rotating elliptical surface with the optical axis to be a central axis, and furthermore, the rear end face formed to pass through the first focal point on the rear side of the rotating elliptical surface. Moreover, the second light transmitting member having the outer peripheral surface formed to surround the light emitting portion almost cylindrically and serving to internally reflect the light emitted from the light emitting portion and the front end face for forward emitting the light emitted from the light emitting portion and reflected internally by the outer peripheral surface is provided between the light transmitting member and the light emitting unit in such a manner that the front end face is caused to come in face contact with the rear end face of the light transmitting member. Therefore, it is possible to obtain the following functions and advantages.

More specifically, a part of the light emitted from the light emitting unit is transmitted through the second light transmitting member and directly reaches the front end face, and furthermore, most of the other lights emitted from the light emitting unit are internally reflected by the outer peripheral surface in the second light transmitting member once or more and then reach the front end face. Thereafter, the light reaching the front end face other than a part of the lights reflected interfacially by the rear end face of the light transmitting member is incident on the light transmitting member without a leakage. Consequently, it is possible to increase a light flux utilization rate for the light emitted from the light emitting unit. In addition, the front end face of the second light transmitting member is provided in face contact with the rear end face of the light transmitting member. Therefore, the light to be reflected interfacially from the rear end face of the light transmitting member can also be controlled to have a very small amount.

In that case, the rear end face of the light transmitting member is formed to pass through the first focal point on the rear side of the rotating elliptical surface constituting the front surface. Therefore, the light distribution pattern formed by the light emitted from the front surface of the light transmitting member has a shape obtained by reversing and projecting the shape of the outer peripheral edge of the front end face of the second light transmitting member provided in face contact with the rear end face. If the shape of the outer peripheral edge of the front end face is set to have a shape obtained by reversing the desirable shape of a light distribution pattern, accordingly, it is possible to obtain the light distribution pattern having the desirable shape.

In addition, the light emitted from the light emitting unit is incident equally on the light transmitting member in the whole area of the front end face of the second light transmitting member. Therefore, it is possible to form a light distribution pattern having a small light distribution unevenness. Moreover, the front end face of the second light transmitting member is provided in face contact with the rear end face of the light transmitting member. Therefore, the front end face can be accurately placed in the position of the first focal point of the rotating elliptical surface. Consequently, it is possible to accurately form a light distribution pattern having a desirable shape.

According to the invention, thus, in the lighting unit for a vehicle in which the light emitting unit is used as the light source, it is possible to increase the luminous flux utilization rate for the light emitted from the light emitting unit, and furthermore, to cause a light distribution pattern formed by the irradiation of a light from the lighting unit for a vehicle to have a small light distribution unevenness.

With the structure, if the eccentricity of the rotating elliptical surface constituting the front surface of the light transmitting member is set to be the inverse number of the refractive index of the light transmitting member, a light transmitted from the first focal point on the rear side of the rotating elliptical surface can be set to be parallel with the optical axis and can be thus emitted from the light transmitting member. Consequently, the light irradiated from the lighting unit for a vehicle can be controlled with higher precision.

In the lighting unit for a vehicle according to the first aspect of the invention, particularly, when the light emitted from the light emitting unit and reaching the position of the front end opening of the reflector is incident on the light transmitting member, it is refracted close to the optical axis over the rear end face of the light transmitting member. Therefore, it is possible to reduce an incidence angle with respect to the front surface when the light incident on the light transmitting member reaches the front surface. Consequently, most of the lights reaching the front surface of the light transmitting member can be emitted forward without a total reflection through the front surface.

Also in the lighting unit for a vehicle according to the second aspect of the invention, moreover, if the refractive index of the second light transmitting member is set to have a smaller value than the reflective index of the light transmitting member, the light emitted from the light emitting unit and reaching the front end face of the second light transmitting member is refracted close to the optical axis over the rear end face of the light transmitting member when it is incident on the light transmitting member. Therefore, it is possible to reduce an incidence angle with respect to the front surface when the light incident on the light transmitting member reaches the front surface. Consequently, most of the lights reaching the front surface of the light transmitting member can be emitted forward without a total reflection through the front surface.

While the specific structure of the "light emitting unit" is not particularly restricted as described above in the structure, the structure of the lighting unit for a vehicle according to the second aspect of the invention can be simplified if the light emitting unit is constituted by a light emitting diode including a light emitting chip and a sealing resin member for sealing the light emitting chip and the sealing resin member is formed integrally with the second light transmitting member. For a specific manner in the "integral formation" of the sealing resin member with the light transmitting member, it is possible to employ a manner in which the sealing resin member is sealed with the second light transmitting member or a manner in which the light emitting chip is directly sealed with the second light transmitting member to have the function of the sealing resin member.

If the inner peripheral edge of the front end opening portion of the reflector according to the first aspect of the invention or the outer peripheral edge of the front end face of the second light transmitting member according to the second aspect of the invention is set to be almost fan-shaped with a straight line portion on a lower edge and the straight line portion is formed to pass through the vicinity of the optical axis, furthermore, it is possible to form a light distribution pattern having, on an upper edge, a cutoff line to be the reversed and projected image of the straight line portion. Consequently, the lighting unit for a vehicle can be suitable for the formation of a light distribution pattern for a low beam.

In this case, if the light emitting unit is provided in such a manner that the light emitting portion is positioned in the vicinity of the upper part of the optical axis, the density of the light reaching the front end opening portion of the reflector or the front end face of the second light transmitting member can be enhanced in the vicinity of a lower edge thereof. Consequently, it is possible to form a hot zone in the vicinity of the cutoff line of the light distribution pattern. Thus, it is possible to enhance the visibility of a long distance area by preventing a short distance area on the forward road surface of the vehicle from being excessively bright.

DETAILED DESCRIPTION OF THE INVENTION

Embodiments of the invention will be described below with reference to the drawings.

Figure 1:
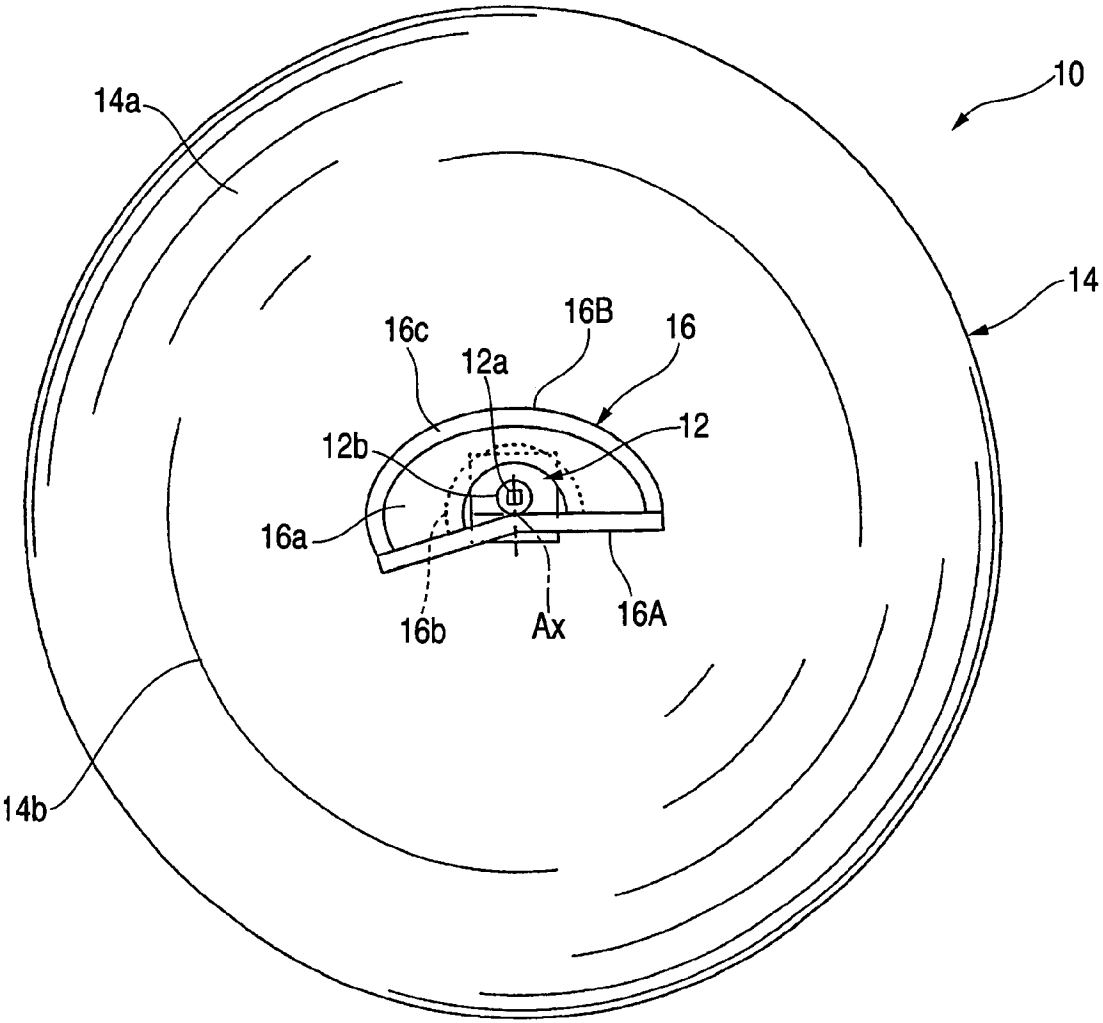
FIG. 1 is a front view showing a lighting unit for a vehicle according to an exemplary, non-limiting first embodiment of the invention.
Figure 2:
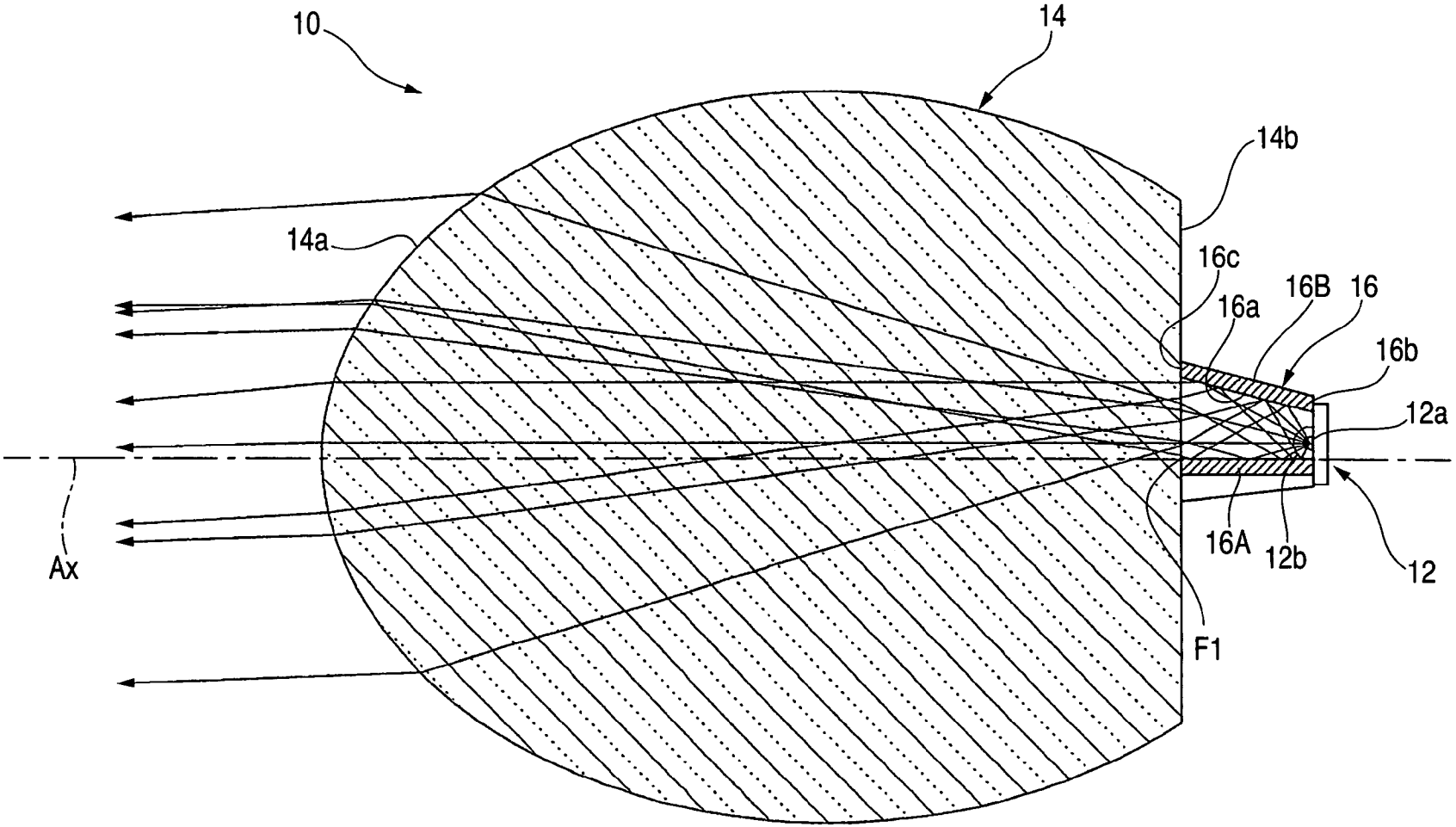
FIG. 2 is a sectional side view showing the lighting unit for a vehicle according to the exemplary, non-limiting first embodiment of the invention.
Figure 3:
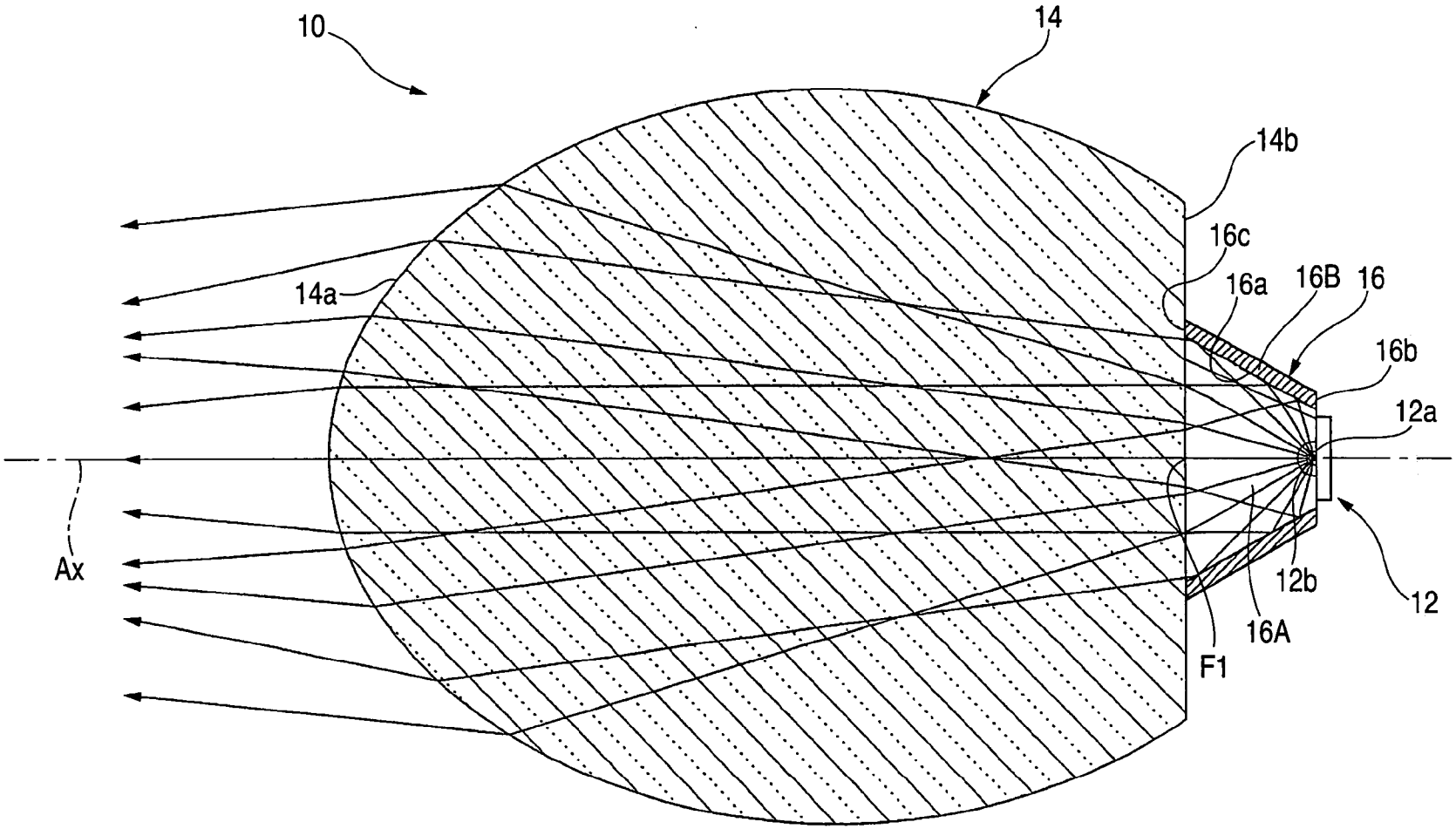
FIG. 3 is a sectional plan view showing the lighting unit for a vehicle according to the exemplary, non-limiting first embodiment of the invention.

First, a first embodiment of the invention is disclosed. FIG. 1 is a front view showing a lighting unit 10 for a vehicle according to the first embodiment, and FIGS. 2 and 3 are a sectional side view and a sectional plan view, respectively. In this embodiment, the lighting unit 10 for a vehicle is a headlamp unit, and is constituted to irradiate a light for forming a light distribution pattern for a low beam. However, the lighting unit 10 need not be limited to a headlamp unit, and other lighting requirements for a vehicle or other use that may be satisfied by the present invention, as would be understood by one of ordinary skill in the art, also form part of the present invention.

The lighting unit 10 comprises a light emitting unit 12 provided forward in the vicinity of an optical axis Ax extended in the longitudinal direction of the vehicle, a light transmitting member 14 provided on the forward side of the light emitting unit 12, and a reflector 16 provided between the light transmitting member 14 and the light emitting unit 12. The lighting unit 10 is attached to the vehicle in a state in which the optical axis Ax can be extended in a downward direction by approximately 0.5 to 0.6 degree with respect to the longitudinal direction of the vehicle.

Figure 4:
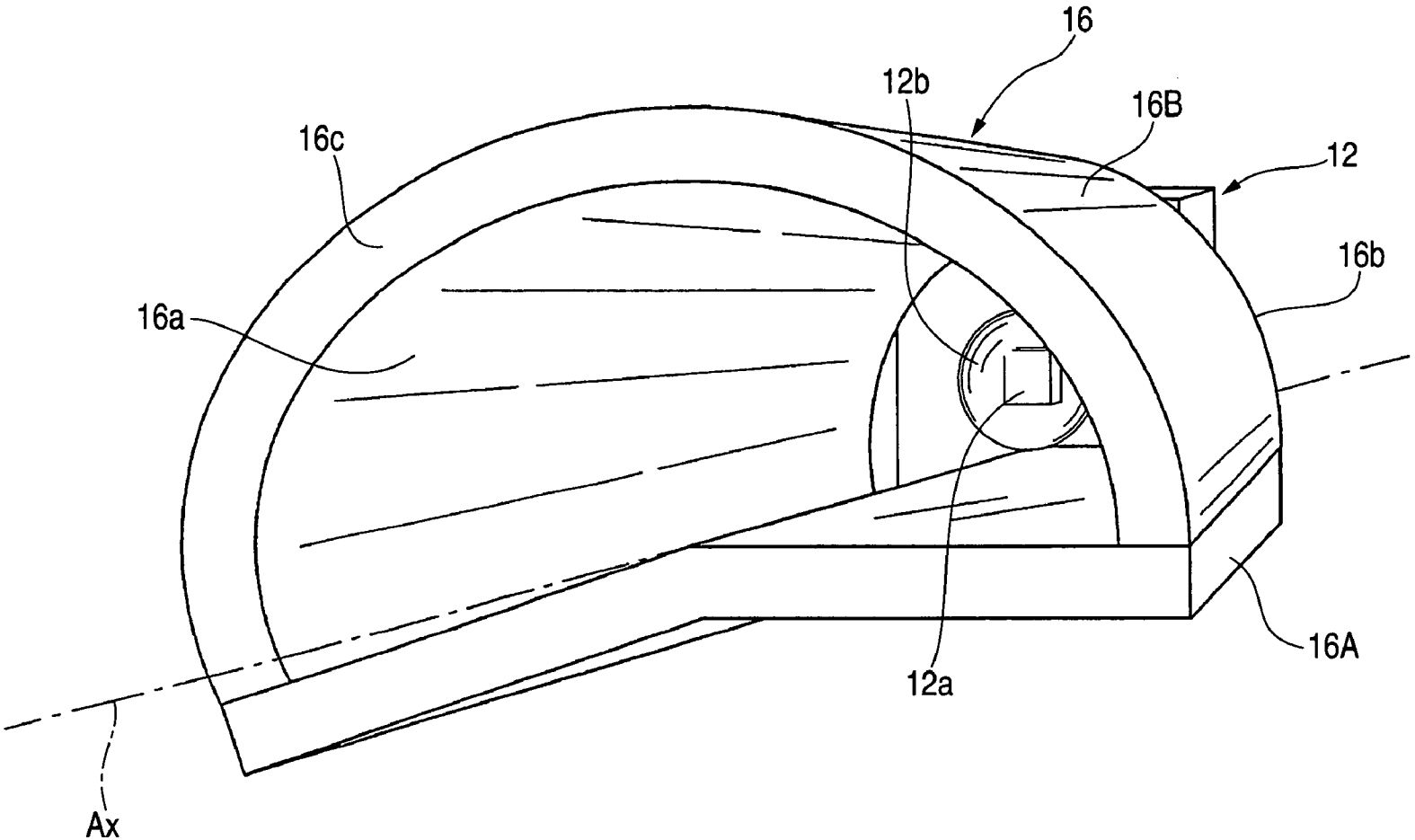
FIG. 4 is a perspective view showing a light emitting unit and a reflector in the lighting unit for a vehicle according to the exemplary, non-limiting first embodiment of the invention.

FIG. 4 is a perspective view showing the light emitting unit 12 and the reflector 16. The light emitting unit 12 is a white light emitting unit including a light emitting chip 12*a* having a size of approximately 0.3 to 3 mm square, and a sealing resin member 12*b* for sealing the light emitting chip 12*a* and is fixed to a rear end face 16*b* of the reflector 16 in order to position the light emitting chip 12*a* in the vicinity of the upper part of the optical axis Ax.

The light transmitting member 14 is a block-shaped member formed of a transparent resin, and a front surface 14*a* is constituted by a rotating elliptical surface with the optical axis Ax to be a central axis. A rear end face 14*b* is constituted by a plane which passes through a first focal point F1 on the rear side of the rotating elliptical surface constituting the front surface 14*a* and is orthogonal to the optical axis Ax. In that case, an eccentricity e of the rotating elliptical surface constituting the front surface 14*a* of the light transmitting member 14 is set to be an inverse number of a refractive index n of the light transmitting member 14 (that is, e=1/n).

The reflector 16 has a reflecting plane 16*a* that surrounds the light emitting chip 12*a* almost cylindrically and is fixed to the light transmitting member 14 to cause a front end opening portion 16*c* to abut on the rear end face 14*b* of the light transmitting member 14.

The reflector 16 is constituted by a lower wall portion 16A having an internal surface formed as a plane, and an upper wall portion 16B having an internal surface formed as a curved surface. The inner peripheral surfaces of the lower wall portion 16A and the upper wall portion 16B are subjected to mirror finishing by aluminum deposition, thereby constituting the reflecting plane 16*a*.

In that case, the internal surface of the lower wall portion 16A is turned down at its corners by setting the optical axis Ax to be a boundary. The left portion of the optical axis Ax is extended in a horizontal direction. Furthermore, the right portion of the optical axis Ax is extended downward at 15 degrees with respect to the horizontal direction. On the other hand, the internal surface of the upper wall portion 16B has a sectional shape orthogonal to the optical axis Ax, which is set to be an oblong and approximately semielliptical shape. The internal surface of the upper wall portion 16B is formed such that the sectional shape is enlarged gradually from a rear edge toward a front edge. Furthermore, the sectional shape is gradually changed from an almost semicircular shape to an oblong and almost semielliptical shape.

As shown in FIGS. 2 and 3, a part of the light emitted from the light emitting unit 12 directly reaches the position of the front end opening of the reflector 16. Most of other lights emitted from the light emitting unit 12 are reflected by the reflecting plane 16*a* of the reflector 16 once or more, and then reach the position of the front end opening. Thereafter, the light reaching the position of the front end opening other than a portion of the light reflected by the surface of the rear end face 14*b* of the light transmitting member 14 is incident on the light transmitting member 14, without leakage.

Figure 5:
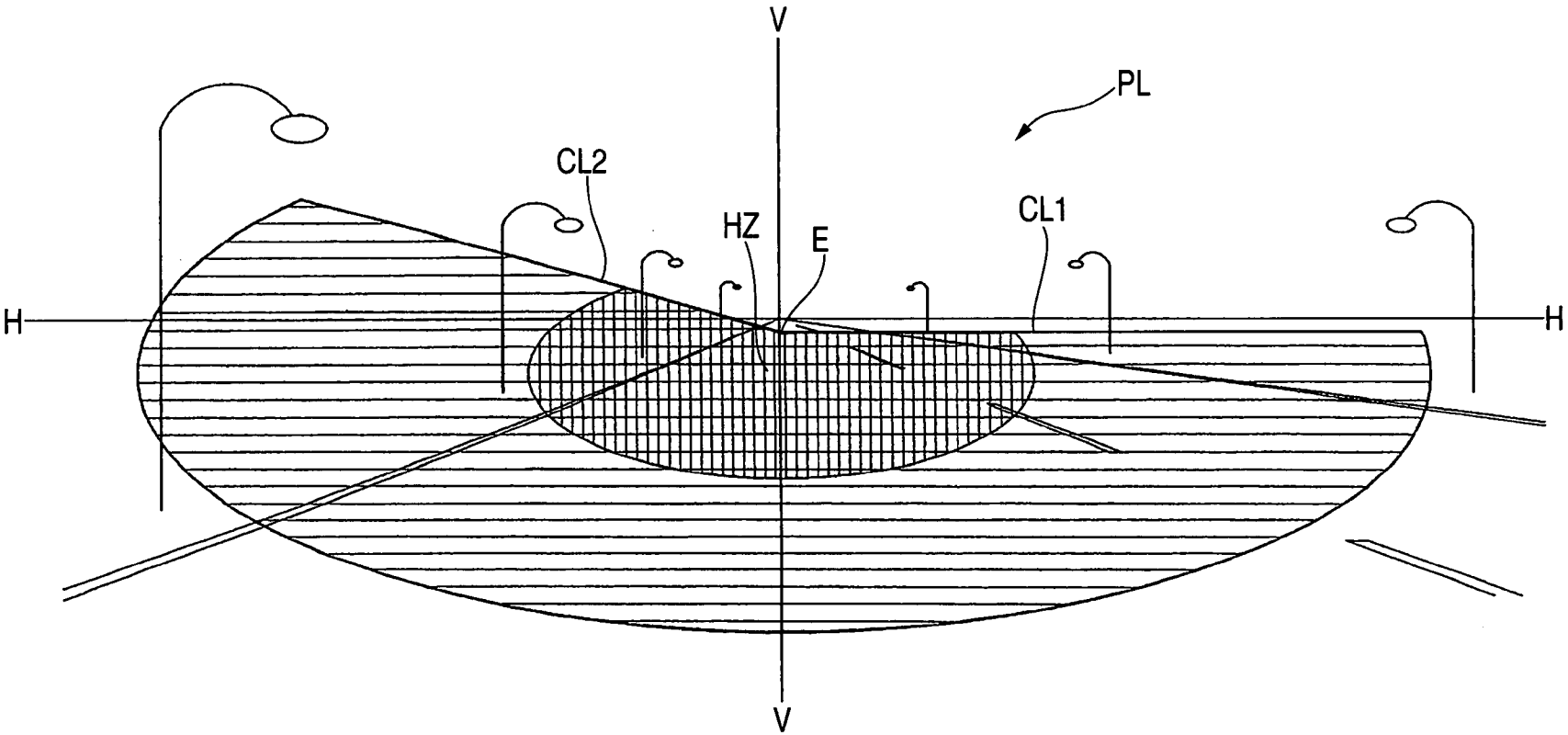
FIG. 5 is a perspective view showing a light distribution pattern for a low beam which is formed on a virtual vertical screen provided forward from the lighting unit for a vehicle by a light irradiated forward therefrom, according to the exemplary, non-limiting first embodiment of the invention.

FIG. 5 is a perspective view showing a light distribution pattern PL for a low beam formed on a virtual vertical screen provided in a forward position of 25 m from the lighting unit 10 for a vehicle according to the first embodiment, by a light irradiated forward therefrom.

The light distribution pattern PL for a low beam has a left light distribution, and has a horizontal cutoff line CL1 on an upper edge and an oblique cutoff line CL2 rising from the horizontal cutoff line CL1 at 15 degrees, and an elbow point E to be the intersecting point of both of the cutoff lines CL1 and CL2 is set into a position placed below at approximately 0.5 to 0.6 degree from H-V to be a vanishing point in the forward direction of the lighting unit. In the light distribution pattern PL for a low beam, a hot zone HZ is formed to substantially surround the elbow point E.

The light distribution pattern PL for a low beam is formed such that the rear end face 14*b* of the light transmitting member 14 passes through the first focal point F1 on the rear side of the rotating elliptical surface constituting the front surface 14*a*, and therefore takes a shape obtained by reversing and projecting the shape of the inner peripheral edge of the front end opening portion 16*c* of the reflector 16 which abuts on the rear end face 14*b*.

In that case, the horizontal cutoff line CL1 is formed by a straight line portion extended in a horizontal direction at a lower edge on the inner periphery of the front end opening portion 16*c* of the reflector 16 (that is, a portion positioned on the left side of the optical axis Ax). The oblique cutoff line CL2 is formed by a straight line portion extended in an oblique direction at a lower edge on the inner periphery of the front end opening portion 16*c* of the reflector 16 (that is, a portion positioned on the right side of the optical axis Ax).

Moreover, the outer peripheral edge of the light distribution pattern PL for a low beam is formed by a curved line portion constituting an upper edge on the inner periphery of the front end opening portion 16*c* of the reflector 16.

The light distribution pattern PL for a low beam has a small light distribution unevenness, because a light emitted from the light emitting unit 12 is incident equally on the light transmitting member 14 in the whole area of a space on the inner peripheral side of the front end opening portion of the reflector 16.

According to the first embodiment, in the lighting unit 10 for a vehicle in which the light emitting unit 12 is used as the light source, a luminous flux utilization rate for the light emitted from the light emitting unit 12 can be increased. Furthermore, the light distribution pattern PL for a low beam formed by the irradiation of a light from the lighting unit 10 can be set to have a small light distribution unevenness.

In the first embodiment, when the light emitted from the light emitting unit 12 and reaching the position of the front end opening of the reflector 16 is incident on the light transmitting member 14, it is refracted close to the optical axis Ax at the rear end face 14*b* of the light transmitting member 14. Therefore, it is possible to decrease an incidence angle with respect to the front surface 14*a* when the light incident on the light transmitting member 14 reaches the front surface 14*a*. Consequently, it is possible to forward emit most of the light reaching the front surface 14*a* of the light transmitting member 14 without a total reflection through the front surface 14*a*.

In addition, in the first embodiment, the eccentricity of the rotating elliptical surface constituting the front surface 14*a* of the light transmitting member 14 is set to be the inverse number of the refractive index of the light transmitting member 14. Therefore, it is possible to emit, from the light transmitting member 14, the light from the first focal point F1 on the rear side of the rotating elliptical surface as a light parallel with the optical axis Ax. Consequently, it is possible to control the light irradiated from the lighting unit 10 for a vehicle with substantially higher precision. Thus, the definition of each of the cutoff lines CL1 and CL2 can be further enhanced.

Figure 6:
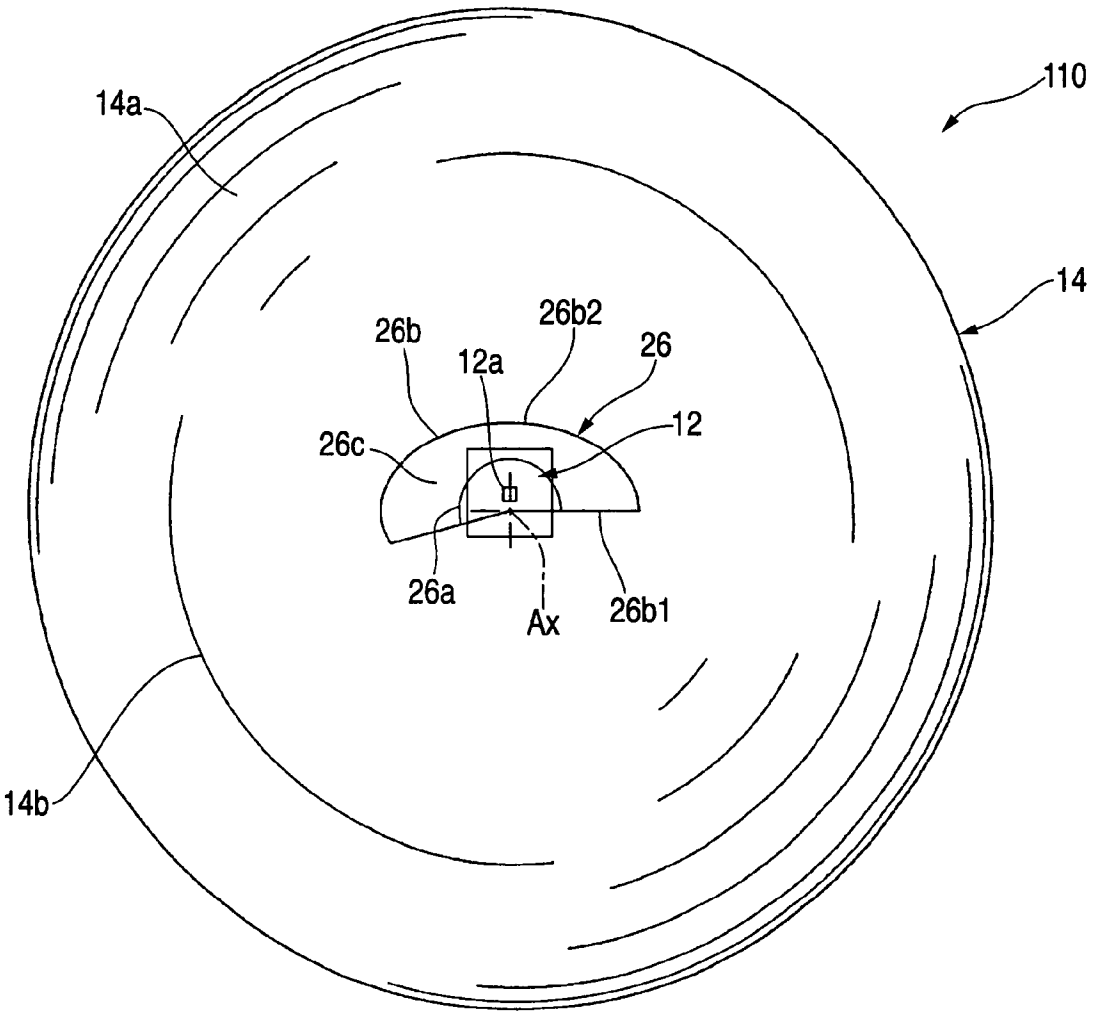
FIG. 6 is a front view showing a lighting unit for a vehicle according to an exemplary, non-limiting second embodiment of the invention.
Figure 7:
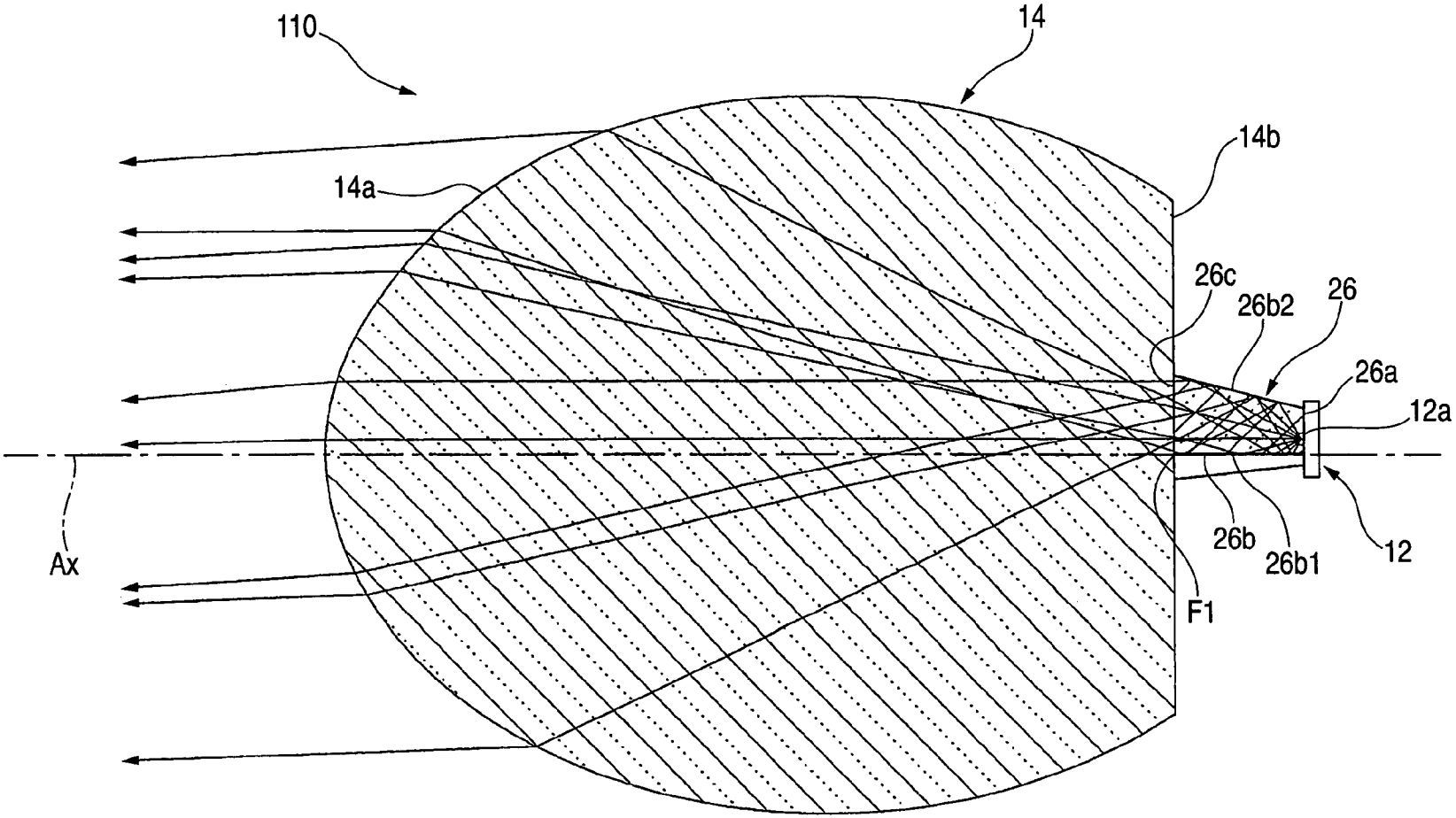
FIG. 7 is a sectional side view showing the lighting unit for a vehicle in FIG. 6, according to the exemplary, non-limiting second embodiment of the invention.
Figure 8:
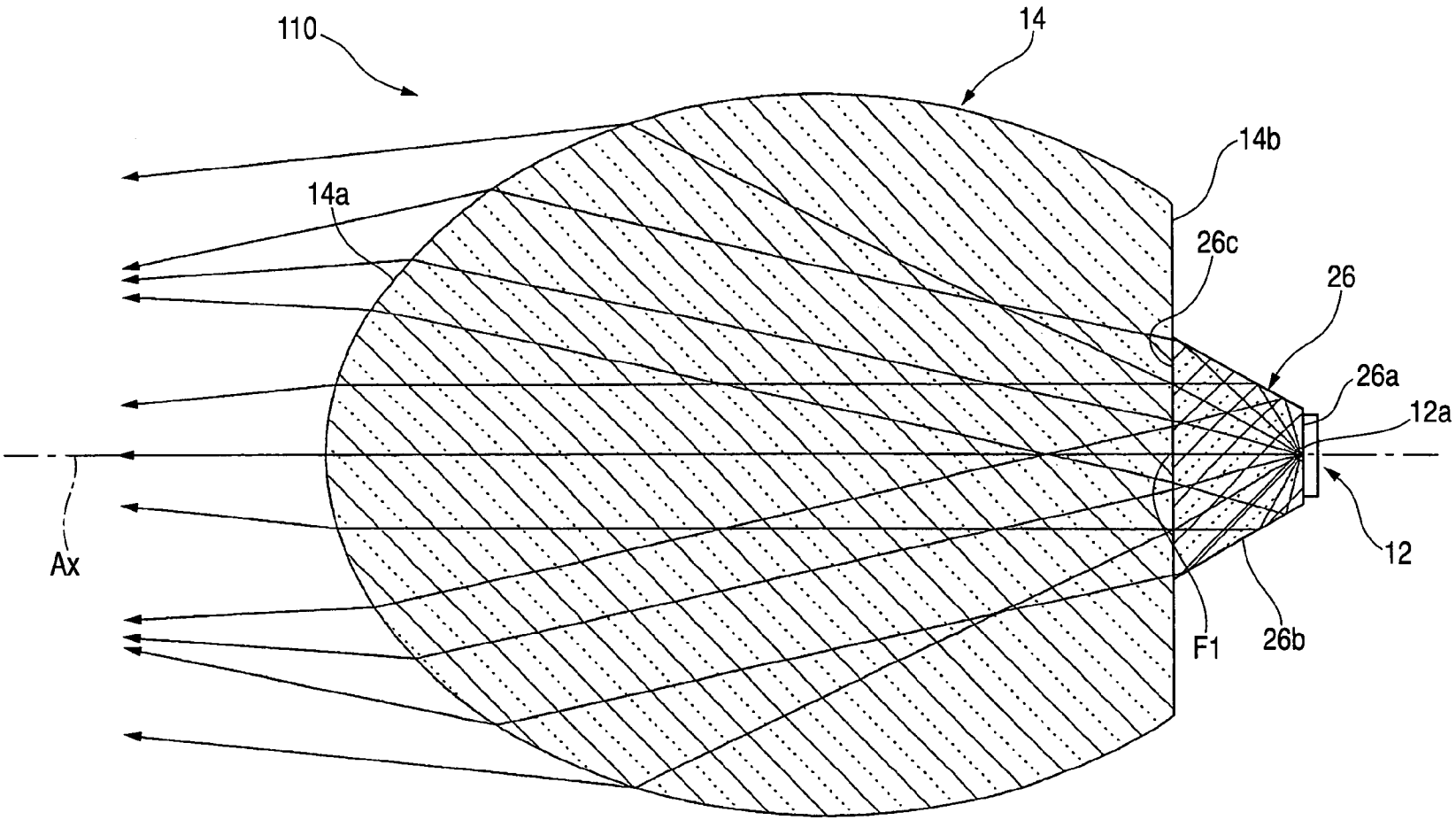
FIG. 8 is a sectional plan view showing the lighting unit for a vehicle in FIG. 6 according to the exemplary, non-limiting second embodiment of the invention.

Next, a second exemplary, non-limiting embodiment of the present invention is disclosed. FIG. 6 is a front view showing a lighting unit 110 for a vehicle according to the second embodiment, and FIGS. 7 and 8 are a sectional side view and a sectional plan view, respectively. The lighting unit 110 for a vehicle is also a headlamp unit and is constituted to irradiate a light for forming a light distribution pattern for a low beam.

The lighting unit 110 for a vehicle has the substantially same basic structure as the lighting unit 10 for a vehicle according to the first embodiment. However, the second embodiment is different from that in the first embodiment in that a second light transmitting member 26 is provided between a light transmitting member 14 and a light emitting unit 12 in place of the reflector 16 of the first embodiment.

Figure 9:
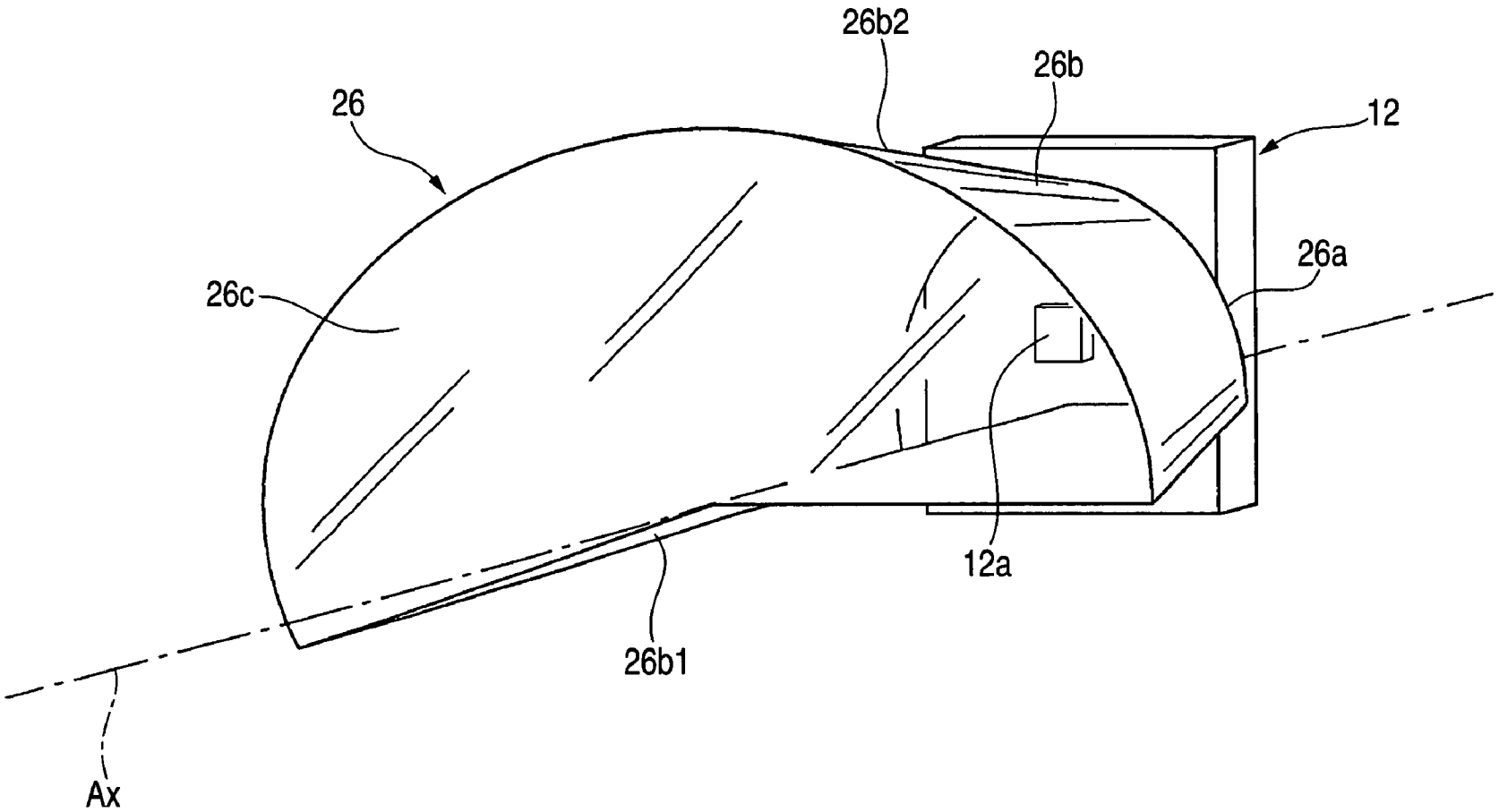
FIG. 9 is a perspective view showing a light emitting unit and a second light transmitting member in the lighting unit for a vehicle in FIG. 6, according to the exemplary, non-limiting second embodiment of the invention.

FIG. 9 is a perspective view showing the light emitting unit 12 and the second light transmitting member 26. Similarly, the second light transmitting member 26 is a block-shaped member formed by a transparent resin and has an outer surface constituted by a rear end face 26*a*, an outer peripheral surface 26*b* and a front end face 26*c*. A refractive index thereof is set to have a smaller value than the refractive index of the light transmitting member 14.

The rear end face 26*a* of the second light transmitting member 26 is constituted by a plane orthogonal to an optical axis Ax, and the light emitting unit 12 is fixed to the rear end face 26*a*. In that case, the second light transmitting member 26 directly seals a light emitting chip 12*a* of the light emitting unit 12. Consequently, the second light transmitting member 26 has the function of a sealing resin member 12*b* according to the first embodiment.

The outer peripheral surface 26*b* of the second light transmitting member 26 surrounds the light emitting chip 12*a* of the light emitting unit 12 substantially cylindrically, and internally reflects a light emitted from the light emitting chip 12*a*. To implement the second embodiment, the outer peripheral surface 26*b* is subjected to mirror finishing by aluminum deposition.

The outer peripheral surface 26*b* is constituted by a lower wall surface 26*b*1 formed like a plane and an upper wall surface 26*b*2 formed like a curved surface. In that case, the lower wall surface 26*b*1 is formed to be turned down at corners by setting the optical axis Ax to be a boundary and the left portion of the optical axis Ax is extended in a horizontal direction and the right portion of the optical axis Ax is extended downward at 15 degrees with respect to the horizontal direction in the substantially same manner as the internal surface of a lower wall portion 16A of the reflector 16. Moreover, the upper wall surface 26*b*2 has an orthogonal sectional shape to the optical axis Ax to be an oblong and approximately semielliptical shape, and is formed such that the sectional shape is gradually enlarged from a rear edge toward a front edge and is gradually changed from an almost semicircular shape to the oblong and almost semielliptical shape in the substantially same manner as the internal surface of an upper wall portion 16B of the reflector 16.

The front end face 26*c* of the second light transmitting member 26 is constituted by a plane orthogonal to the optical axis Ax, and is formed to forward emit a light from the light emitting chip 12*a* which is reflected internally by the outer peripheral surface 26*b*. The second light transmitting member 26 is fixed to the light transmitting member 14 such that the front end face 26*c* makes face contact with a rear end face 14*b* of the light transmitting member 14.

As shown in FIGS. 7 and 8, a part of the light emitted from the light emitting unit 12 directly reaches the front end face 26*c* of the second light transmitting member 26. Furthermore, most of other lights emitted from the light emitting unit 12 are reflected internally by the outer peripheral surface 26*b* of the second light transmitting member 26 once or more, and then reach the front end face 26*c*. Thereafter, all of the lights reaching the front end face 26*c* are incident on the light transmitting member 14 except for the very small number of lights reflected interfacially by the rear end face 14*b* of the light transmitting member 14.

A light distribution pattern for a low beam formed by the irradiation of a light from the lighting unit 110 for a vehicle according to the second embodiment is almost the same as the light distribution pattern PL for a low beam which is formed by the irradiation of a light from the lighting unit 10 for a vehicle according to the first embodiment.

In the first embodiment, the light distribution pattern for a low beam has a shape obtained by reversing and projecting the shape of the outer peripheral edge of the front end face 26*c* of the second light transmitting member 26 which is provided in face contact with the rear end face 14*b* of the light transmitting member 14. Moreover, the light distribution pattern for a low beam has a substantially small light distribution unevenness, because the light emitted from the light emitting unit 12 is incident equally on the light transmitting member 14 in the whole area of the front end face 26*c* of the second light transmitting member 26.

According to the second embodiment, in the lighting unit 110 for a vehicle in which the light emitting unit 12 is used as the light source, a luminous flux utilization rate for the light emitted from the light emitting unit 12 can be increased. Furthermore, the light distribution pattern for a low beam which is formed by the irradiation of a light from the lighting unit 110 for a vehicle can be set to have a small light distribution unevenness.

In the second embodiment, more particularly, the refractive index of the second light transmitting member 26 is set to have a smaller value than the refractive index of the light transmitting member 14, and the light emitted from the light emitting unit 12 and reaching the front end face 26*c* of the second light transmitting member 26 is refracted substantially close to the optical axis Ax over the rear end face 14*b* of the light transmitting member 14 when it is incident on the light transmitting member 14.

Therefore, it is possible to reduce an incidence angle with respect to a front surface 14*a* when the light incident on the light transmitting member 14 reaches the front surface 14*a*. Consequently, most of the lights reaching the front surface 14*a* of the light transmitting member 14 can be emitted forward without a total reflection through the front surface 14*a*.

In the second embodiment, a structure is employed in which the light emitting chip 12*a* of the light emitting unit 12 is directly sealed with the second light transmitting member 26. Therefore, it is possible to simplify the structure of the lighting unit 110.

Figure 10:
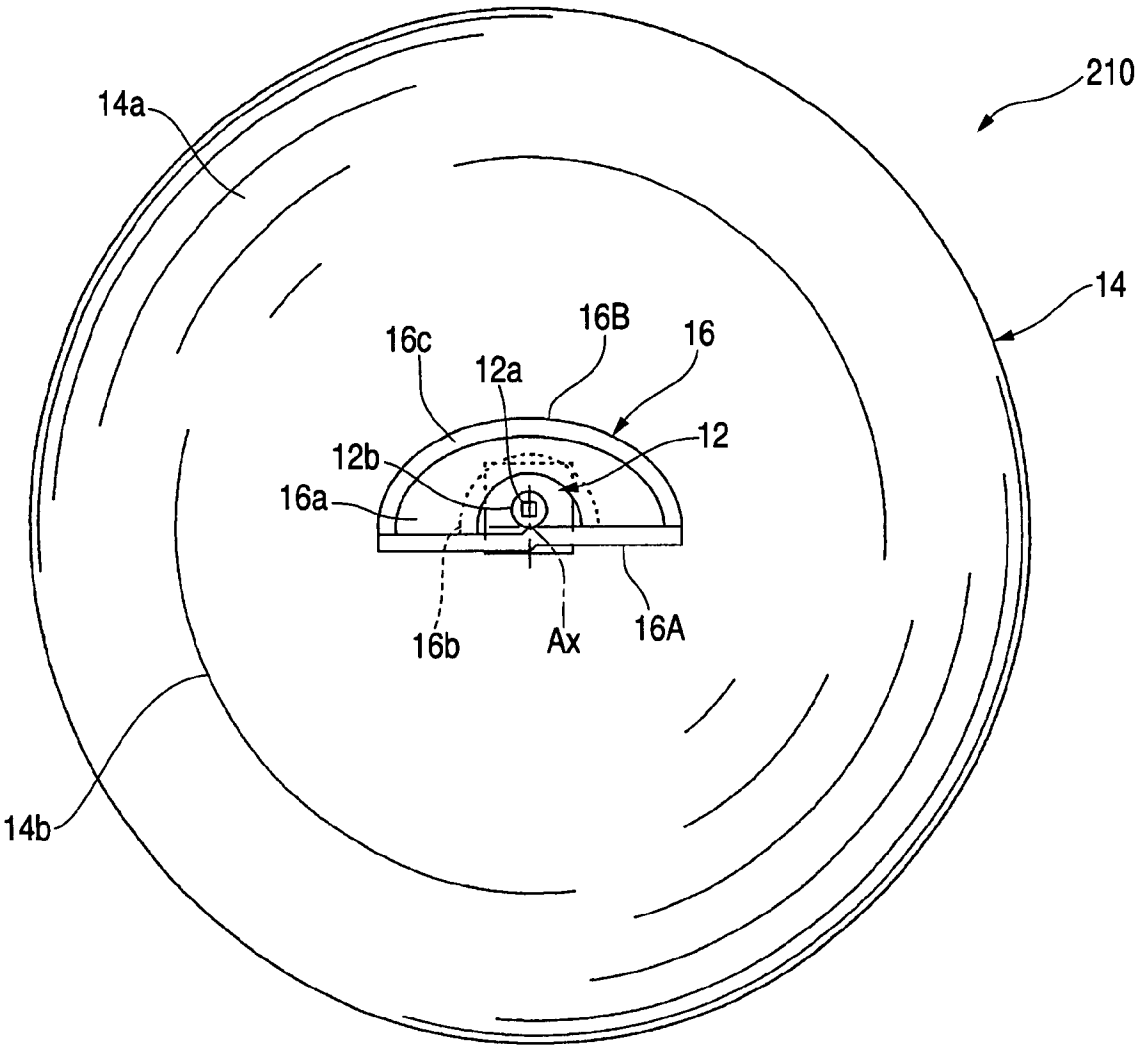
FIG. 10 is a front view showing a lighting unit for a vehicle according to an exemplary, non-limiting third embodiment of the invention.

Next, description will be given to a third exemplary, non-limiting embodiment of the present invention. FIG. 10 is a front view showing a lighting unit 210 for a vehicle according to the third embodiment. The lighting unit 210 for a vehicle is also a headlamp unit and is constituted to irradiate a light for forming a light distribution pattern for a low beam.

The lighting unit 210 for a vehicle has the same basic structure as that of the lighting unit 10 for a vehicle according to the first embodiment. However, the third embodiment is different from the first embodiment in terms of the structure of a reflector 16.

In other words, also in the reflector 16 according to the third embodiment, the inner peripheral edge of a front end opening portion 16*c* is set to be almost fan-shaped with a straight line portion on a lower edge in the same manner as in the reflector 16 according to the first embodiment, and a central angle is different from that in the first embodiment.

More specifically, the reflector 16 according to the third embodiment is also constituted by a lower wall portion 16A having an internal surface formed like a plane and an upper wall portion 16B having an internal surface formed like a curved surface, and the internal surface of the lower wall portion 16A is constituted by a laterally uneven horizontal plane and is formed to be bent downward on an optical axis Ax.

Figure 11:
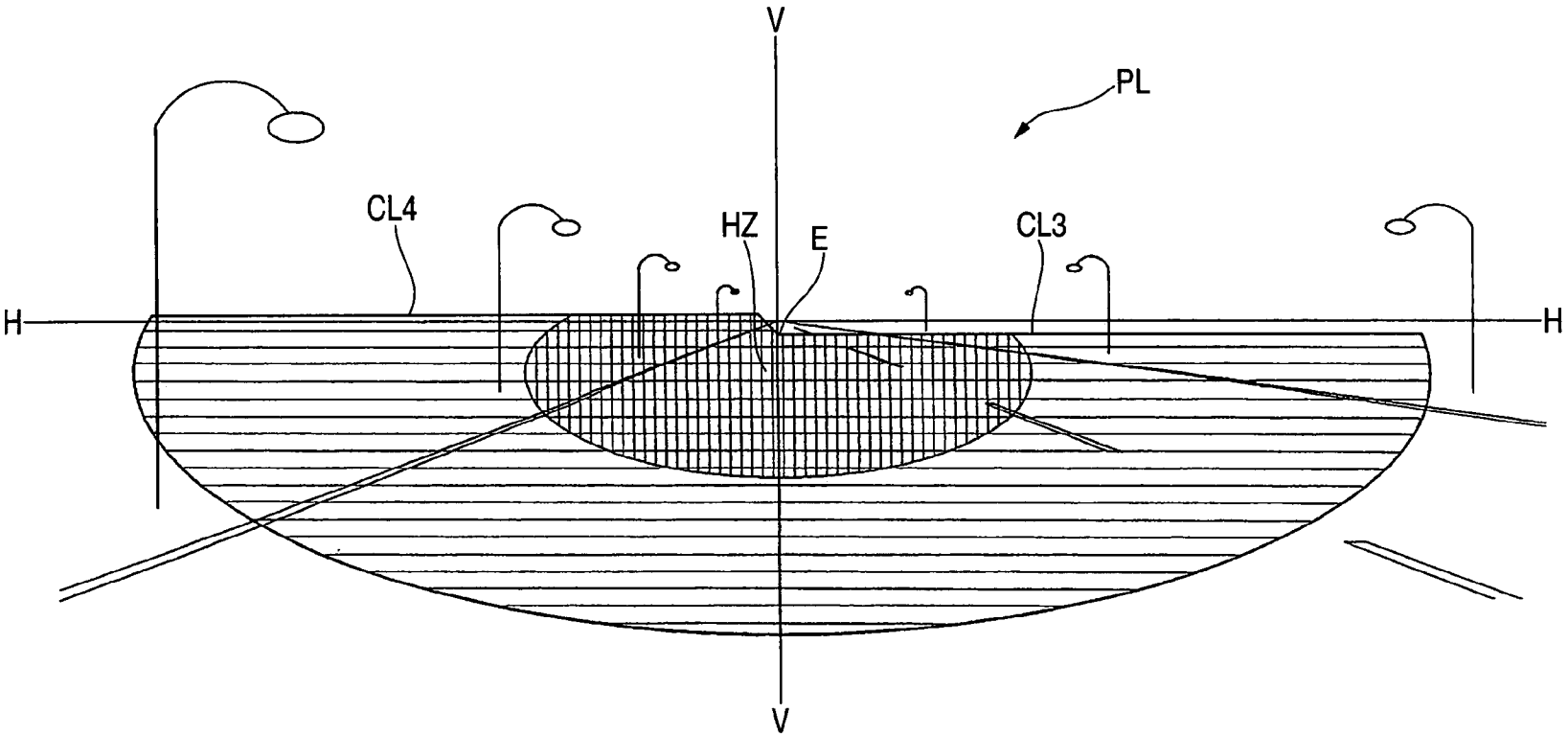
FIG. 11 is a perspective view showing a light distribution pattern for a low beam which is formed on a virtual vertical screen by a light irradiated forward from the lighting unit for a vehicle in FIG. 10, according to the exemplary, non-limiting third embodiment of the invention.

FIG. 11 is a perspective view showing a light distribution pattern PL for a low beam which is formed on a virtual vertical screen provided in a forward position of about 25 m from the lighting unit 210 for a vehicle according to the third embodiment by a light irradiated forward therefrom.

The light distribution pattern PL for a low beam has a left light distribution and includes laterally uneven cutoff lines CL3 and CL4 on an upper edge thereof. The cutoff lines CL3 and CL4 are formed as reversed and projected images for the lower edge of the inner periphery of the front end opening portion 16*c* of the reflector 16. An opposite lane side portion on the right side of a V-V line is formed as the cutoff line CL3 in a lower stage, and a self-lane side portion on the left side of the V-V line is formed as the cutoff line CL4 in an upper stage which is provided upstairs through an inclined portion from the cutoff line CL3 in a lower stage.

When the structure according to the third embodiment is employed, it is possible to obtain the same functions and advantages as those in the first embodiment, except that the shapes of the cutoff lines CL3 and CL4 of the light distribution pattern PL for a low beam are different from those in the first embodiment.

Additionally, the structure of the third embodiment may also be applied in the case of the light transmitting member that is used in the second embodiment. For example, but not by way of limitation, the fan-shaped upper portion and the lower portion would have substantially the same shape. However, instead of a reflector, the light transmitting member would be employed.

Figure 12:
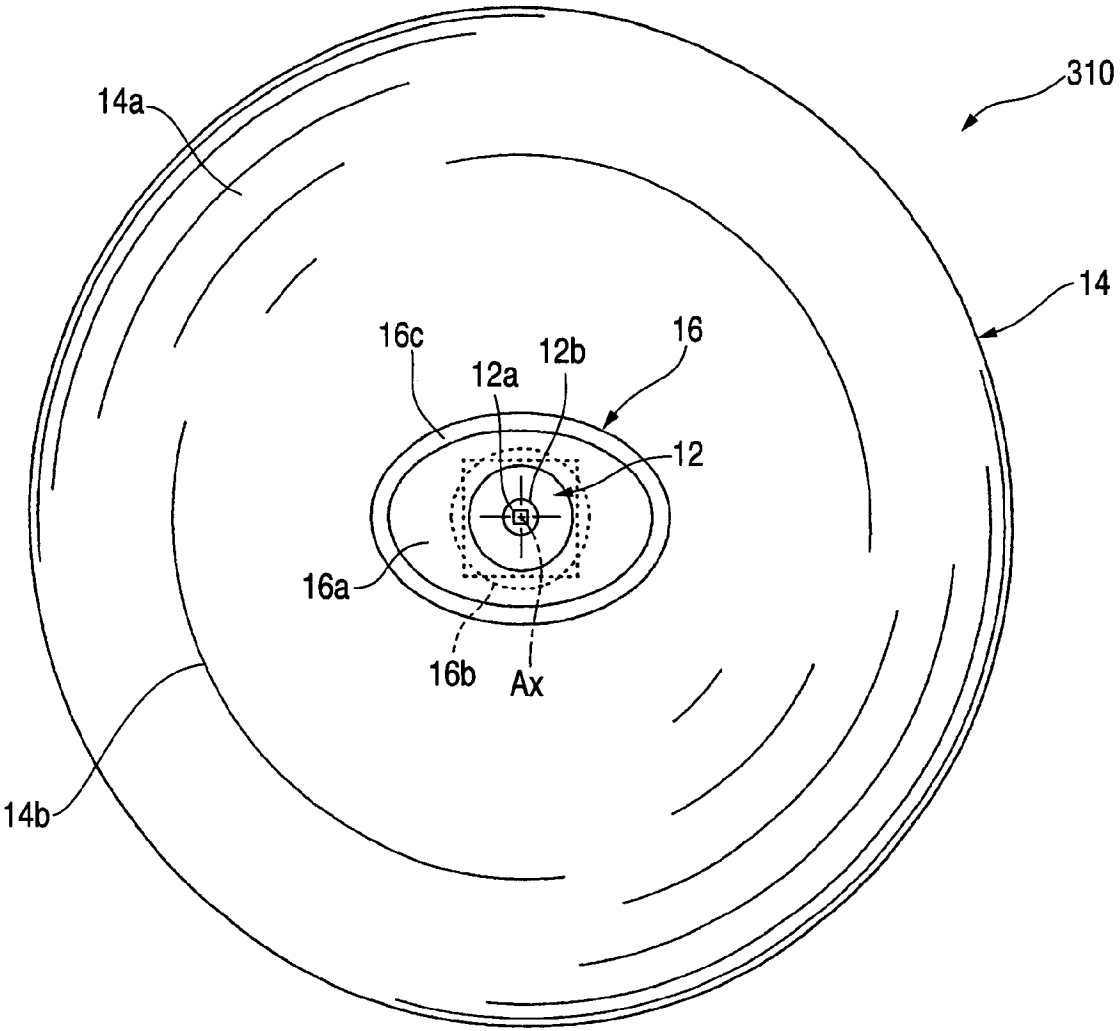
FIG. 12 is a front view showing a lighting unit for a vehicle according to an exemplary, non-limiting fourth embodiment of the invention.

Next, description will be given to a fourth exemplary, non-limiting embodiment of the present invention. FIG. 12 is a front view showing a lighting unit 310 for a vehicle according to the fourth embodiment. The lighting unit 310 for a vehicle is also a headlamp unit and is constituted to irradiate a light for forming a light distribution pattern for a high beam.

The lighting unit 310 for a vehicle has the same basic structure as that of the lighting unit 10 for a vehicle according to the first embodiment. However, the fourth embodiment is different from the first embodiment in terms of the arrangement of a light emitting unit 12 and the structure of a reflector 16.

More specifically, the light emitting unit 12 according to the fourth embodiment is fixed to a rear end face 16*b* of the reflector 16 such that a light emitting chip 12*a* is positioned on an optical axis Ax.

Moreover, the reflector 16 according to the fourth embodiment is constituted by a peripheral wall having an internal curved surface with the optical axis Ax to be a center, and a reflecting plane 16*a* has a shape extended over the whole periphery of the internal surface of the upper wall portion 16B in the reflector 16 according to the first embodiment.

The lighting unit 310 for a vehicle according to the fourth embodiment is attached to the vehicle in a state in which the optical axis Ax is extended in the longitudinal direction of the vehicle.

Figure 13:
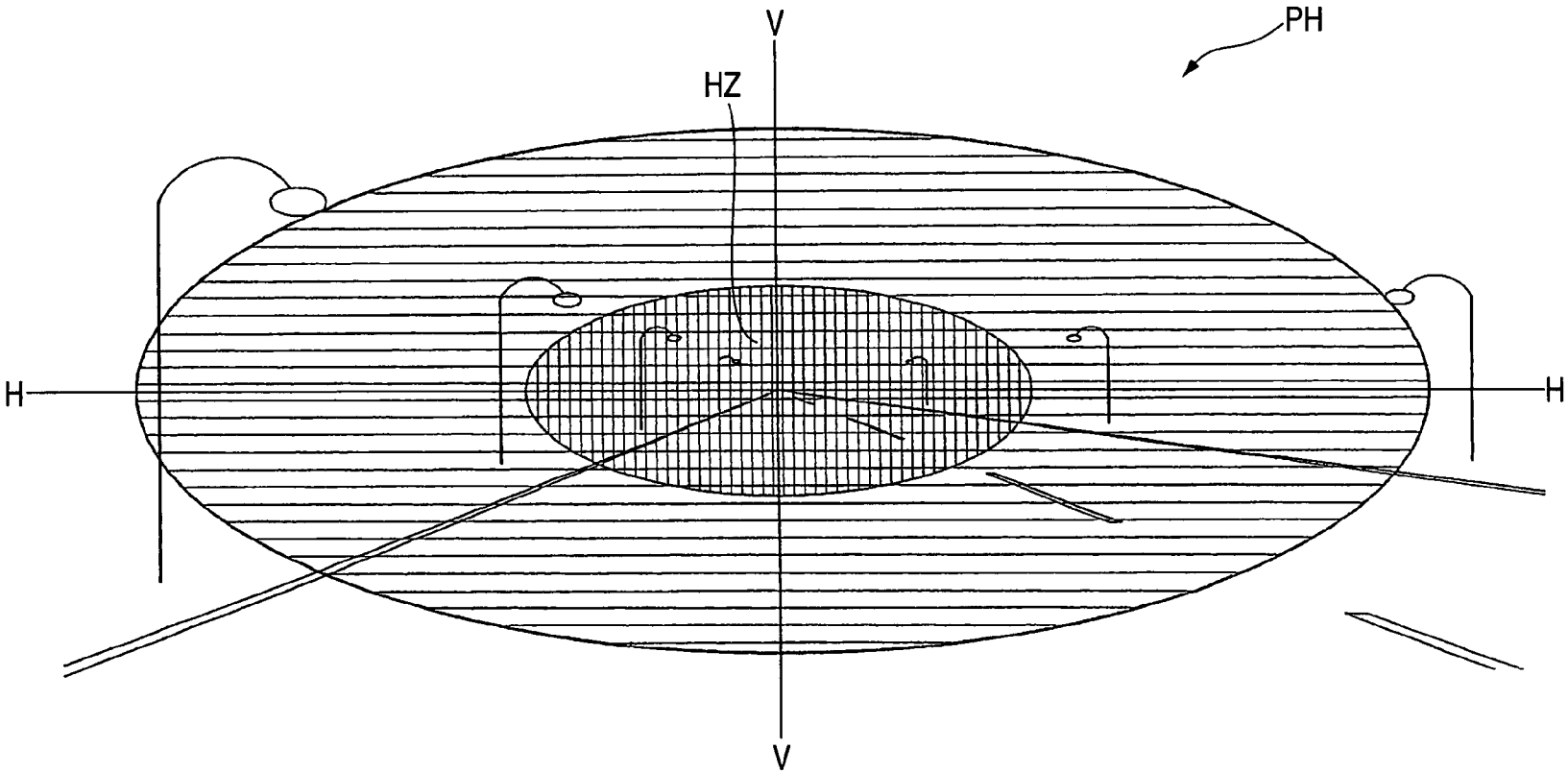
FIG. 13 is a perspective view showing a light distribution pattern for a high beam which is formed on a virtual vertical screen by a light irradiated forward from the lighting unit for a vehicle in FIG. 12, according to the exemplary, non-limiting fourth embodiment of the invention.

FIG. 13 is a perspective view showing a light distribution pattern PH for a high beam which is formed on a virtual vertical screen provided in a forward position of about 25 m from the lighting unit 310 for a vehicle according to the fourth embodiment by a light irradiated forward therefrom. The light distribution pattern PH for a high beam is an oblong light distribution pattern expanded greatly on both left and right sides of a V-V line and a hot zone HZ is formed around H-V.

When the structure according to the fourth embodiment is employed, it is possible to obtain the same functions and advantages as those in the first embodiment, except that the shape of the light distribution pattern is substantially different from that in the first embodiment.

Additionally, the structure of the fourth embodiment may also be applied in the case of the light transmitting member that is used in the second embodiment. For example, but not by way of limitation, the curved inner periphery of the fourth embodiment reflector would instead be a curved outer periphery of the light transmitter according to the second embodiment.

The description has been given on the assumption that the surface of the light transmitting member 14 is formed such that the front surface 14*a* constituted by the rotating elliptical surface is extended to the rear end face 14*b* in each of the embodiments. Referring to the rear region of the front surface 14*a* that the light emitted from the light emitting unit 12 does not reach, it is also possible to take the shape of the surface other than the rotating elliptical surface.

The description has been given on the assumption that the light emitting chip 12*a* of the light emitting unit 12 is formed to have a size of approximately 0.3 to 3 mm square in each of the embodiments. However, it is also possible to use a light emitting chip taking another external shape (for example but not by way of limitation, an oblong rectangular shape).

When a headlamp for a vehicle is to be constituted by the lighting units 10, 110, 210 and 310 for a vehicle according to the foregoing embodiments, it is preferable that a plurality of lighting units 10, 110, 210 or 310 for a vehicle according to each of the embodiments should be used together or in proper combination with other lighting units for a vehicle.

While the invention has been described above with reference to the embodiment, the technical range of the invention is not restricted to the range described in the embodiment. It is apparent to the skilled in the art that various changes or improvements can be made in the embodiment. It is apparent from the appended claims that the embodiment thus changed or improved can also be included in the technical range of the invention.

The invention claimed is:

1. A lighting unit comprising:

a light emitting unit facing forward with respect to an optical axis in a longitudinal direction of the lighting unit;

a first light transmitting member on a forward side of the light emitting unit, said first light transmitting member having a front surface comprising a rotating elliptical surface with the optical axis as a central axis, and a rear end face passing through a first focal point on a rear side of the rotating elliptical surface; and a second light transmitting member having an outer peripheral surface that surrounds a light emitting port ion of the light emitting unit substantially cylindrically and internally reflects a light emitted from the light emitting portion and a front end face, for forward emitting the light from the light emitting portion and reflected internally by the outer peripheral surface, wherein the second light transmitting member is between the first light transmitting member and the light emitting unit such that the front end face of the second light transmitting member contacts the rear end face of the first light transmitting member.

2. The lighting unit according to claim 1, wherein a refractive index of the second light transmitting member is smaller than a refractive index of the first light transmitting member.

3. The lighting unit according to claim 1, wherein the light emitting unit comprises a light emitting diode including a light emitting chip and a sealing resin member for sealing the light emitting chip, and the sealing resin member is formed integrally with the second light transmitting member.

4. The lighting unit according to claim 1, wherein an inner peripheral edge of the front end opening portion of an outer peripheral edge of the front end face of the second light transmitting member is set to be almost fan-shaped with a straight line portion on a lower edge, and the straight line portion is formed to pass through the vicinity of the optical axis.

5. The lighting unit according to claim 1, wherein the light emitting unit is provided such that the light emitting portion is positioned in the vicinity of the upper part of the optical axis.

6. The lighting unit according to claim 1, said second light transmitting member comprising a lower wall portion having an outer peripheral surface formed as a plane, and an upper wall portion having an outer peripheral surface formed as a curved surface.

7. The lighting unit of claim 6, wherein the outer peripheral surface of the lower wall portion is turned down at the corners of the lower wall portion by setting the optical axis to as a boundary, so that a left portion of the optical axis is extended in a horizontal direction and a right portion of the optical axis is extended downward at an angle with respect to the horizontal direction.

8. The lighting unit of claim 6, wherein the outer peripheral surface of the upper wall portion is substantially orthogonal to the optical axis, and is oblong and substantially semielliptical.

9. The lighting unit of claim 6, wherein the outer peripheral surface of the upper wall portion has a sectional shape that is enlarged gradually from a rear edge toward a front edge, and wherein the sectional shape is gradually changed from substantially semicircular shape to oblong and substantially semielliptical shape.

10. The lighting unit according to claim 1, wherein a peripheral wall of said reflector has a curved outer surface and said optical axis as its center.

* * * * *